United States Patent [19]

Ballard

[11] Patent Number: 5,021,021

[45] Date of Patent: Jun. 4, 1991

[54] MAGNETIC BUILDING BLOCK

[76] Inventor: Scott T. Ballard, 2228 Colquitt, Houston, Tex. 77098

[21] Appl. No.: 469,229

[22] Filed: Jan. 24, 1990

[51] Int. Cl.[5] ..... A63H 33/04; A63H 33/26

[52] U.S. Cl. ..... 446/92; 446/137; 335/285

[58] Field of Search ..... 446/92, 129, 137, 128; 335/306, 285; 273/1 M, 289

[56] References Cited

U.S. PATENT DOCUMENTS

| | | | |
|---|---|---|---|
| 1,236,234 | 8/1917 | Troje . | |
| 2,795,893 | 6/1957 | Vayo . | |
| 2,939,243 | 6/1960 | Duggor . | |
| 3,095,668 | 7/1963 | Dorsett . | |
| 3,451,161 | 6/1969 | Lemelson | 446/138 |
| 3,731,722 | 5/1973 | Carr | 335/285 |
| 3,998,004 | 12/1976 | Ehrlich | 446/92 |
| 4,258,479 | 3/1981 | Roane | 434/211 |
| 4,722,712 | 2/1988 | McKenna | 446/92 |

FOREIGN PATENT DOCUMENTS

| | | | |
|---|---|---|---|
| 1266319 | 5/1961 | France | 446/92 |

OTHER PUBLICATIONS

Catalog pp. 4-1-4-7 of Magnet Sales & Mfg. Co. entitled, "Flexible Magnets".

*Primary Examiner*—Mickey Yu
*Attorney, Agent, or Firm*—Harrison & Egbert

[57] ABSTRACT

A building block having a metallic body, and a magnetic strip extending around the periphery of the body. The magnetic strip is affixed to the metallic body such that the flat surfaces of the metallic body are aligned with the edges of the magnetic strip. The metallic body has a first metallic cap and a second metallic cap aligned with the first metallic cap. The metallic body has corners of curved radius. A filler material is contained between the first metallic cap and the second metallic cap. The magnetic strip has multiple magnetic poles on the exterior surface of the strip. The magnetic strip is of a flexible material arranged in surface-to-surface contact with the periphery of the metallic body. The magnetic strip is laminated continuously around the metallic body.

16 Claims, 2 Drawing Sheets

MAGNETIC BUILDING BLOCK

TECHNICAL FIELD

The present invention relates to building blocks. More particularly, the present invention relates to children's building blocks used for the construction of various shapes.

BACKGROUND ART

Wood blocks have been used as toys for children since almost the beginning of recorded history. Such blocks are commonly employed to build various real or imaginary structures. When used in this manner, wood blocks serve to amuse children, but they also serve a more important function. They serve to educate children as to the fundamental rules which must be filled in building many structures.

In order to increase the educational value of toy blocks, it is known to place upon the surfaces of such blocks various types of indicia such as letters, pictures or the like. Theoretically, a child can learn by placing these blocks together in a given order, as in forming words, a complete picture comprised of a plurality of smaller pictures, or the like. Frequently it is, however, difficult for a child to assemble such blocks together in a desired manner due to the fact that no means are provided upon them for holding adjacent block surfaces against one another.

Many efforts have been made at providing toy block structures including such means. With the advent of modern plastic molding techniques, many toy blocks have been manufactured so as to have special shapes which are adapted so that a surface on one block will fit into a corresponding adjacent surface on another block so as to secure the blocks together. It is also been proposed to hold adjacent toy blocks to one another using bar or other magnets located within the blocks themselves. Various types of snap fasteners have also been proposed for this same use.

U.S. Pat. No. 3,095,668, issued on July 2, 1963, to C. T. Dorsett, describes a type of magnetic block. In this invention, the blocks are made of a convenient non-magnetic substance, such as wood. Magnetic particles are applied to the surface of the blocks with an appropriate binder. In this invention, the blocks have surfaces which are adapted to be held together through the use of magnetic forces. The coating on at least one of the surfaces of the block is composed of the magnetic particles oriented within the coating so as to achieve a holding action in connection with the magnetic particles on the other surface. This invention requires the orienting of each of the blocks so that the magnetic fields on each of the blocks will be attractive, rather than repulsive.

U.S. Pat. No. 2,795,893, issued on June 18, 1957, to H. E. Vayo describes a magnetic toy block. The toy blocks, as described in this patent, are molded of a plastic material. The magnets are fastened to the interior of the molded plastic material. Each of the faces of the block has a differing magnetic polarity. As such, it is also necessary with this invention to align the proper faces so as to create the magnetic adhesion.

U.S. Pat. No. 2,939,243, issued on June 7, 1960, to R. G. Duggar, also shows a magnetic toy building block. Each of the building blocks of this invention are made of a plastic material arranged in a cube-like configuration. Each wall of the cube has a magnet mounted on an adjacent interior surface for rotation about an axis intermediate the poles of the permanent magnet. Suitable means are provided for effecting this rotary movement. In this arrangement, when any two sides or faces of any two blocks are brought into abutting relationship, the associated magnets, due to their polarity, will rotate into a position in which the negative pole of one is aligned with the positive pole of the other, and vice versa.

U.S. Pat. No. 1,236,234, issued on Aug. 7, 1917, to O. R. Trojae, shows another type of magnetized toy building block. Each of the building blocks is provided with openings that extend transversely through the block. Fitted within these openings are permanent bar magnets. These magnets extend completely through the block and have ends disposed flush with the sides of the block. The north pole of one of the magnets is disposed on the side adjacent the side at which the south pole of the other magnet is disposed. When another building block of this same construction is disposed adjacent this one, it will be retained in proper position.

U.S. Pat. No. 4,258,479, issued on Mar. 31, 1981, to P. A. Roane shows a series of interrelated sets of tetrahedrone blocks. Each set is capable of assembly into a cube with all of the cubes being identical in size. The tetrahedrones are preferably hollow and each of them has a magnet for each face. This magnet is affixed to the interior walls of its faces. The magnets are polarized so that upon assembly into a cube or pyramid, the magnets of facing faces attract each other.

Unfortunately, with these prior art patents, it becomes very difficult to standardize the construction of the building block. Additionally, random arrangement is not possible, since alignment of magnetic forces must be obtained. Generally, each of these building blocks has a relatively complicated construction.

It is an object of the present invention to provide a magnetic building block of relatively simple construction.

Is is another object of the present invention to provide a magnetic building block in which each magnetic block may randomly attach to another magnetic block, without the need for alignment of faces.

It is still a further object of the present invention to provide a magnetic building block having a safe and easy to use configuration.

These and other objects and advantages of the present invention will become apparent from a reading of the attached specification and appended claims.

SUMMARY OF THE INVENTION

The present invention is a magnetic building block comprising a metallic body and a magnetic strip extending around the periphery of the metallic body. The magnetic strip is affixed, by adhesives or by other means, to the metallic body. The magnetic strip is of a type having multiple poles on a single surface.

The metallic body comprises a first metallic cap and a second metallic cap. The first metallic cap is aligned with and opposite the second metallic cap. The first metallic cap defines a first flat surface that is aligned with and flush with the edge of the magnetic strip. The second metallic cap defines a second flat surface that is also flush with and aligned with the edge of the magnetic strip. The metallic body has a thickness of between one-quarter inch and one inch. The metallic body also has corners of curved radius. A filler material may be utilized between the first metallic cap and the second metallic cap. This filler material is a styrofoam material having a plastic laminate on each side. The filler material has a configuration that matches the interior configuration of the properly arranged first and second metallic caps and is used for bonding the two caps together. The caps could be designed with a male/female edge to fit together without a filler strip.

The magnetic strip has multiple magnetic poles on the exterior surface of the magnetic strip. This magnetic strip is of a flexible material formed around the exterior of the metallic body. This magnetic strip has an interior surface in surface-to-surface contact with the periphery of the metallic body such that it is completely backed by metal. The magnetic strip is also laminated continuously around the metallic body.

DETAILED DESCRIPTION OF THE INVENTION

Figure 1:
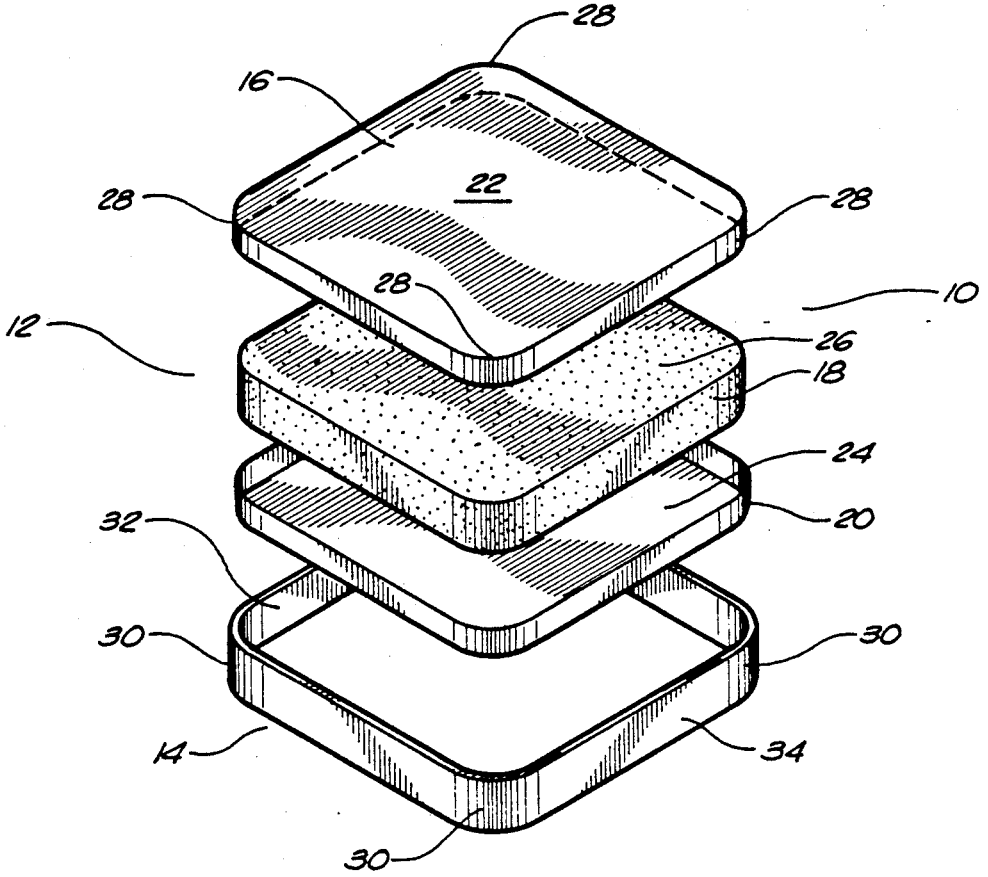
FIG. 1 is an exploded view showing the configuration of the magnetic building block of the present invention.

Referring to FIG. 1, there is shown at 10 an exploded view of the magnetized building block in accordance with the preferred embodiment of the present invention. The magnetized building block 10 comprises a body portion 12 and a magnetic strip 14. In the assembled form, the magnetic strip 14 will extend around the periphery of the body 12.

Relative to FIG. 1, body 12 comprises a first cap 16, an optional filler material 18, and a second cap 20. Each of the caps 16 and 20 is made of a magnetically attractive material, such as a metal. The filler material 18 is contained between caps 16 and 20. The first cap 16 includes a first flat surface 22. The second cap 20 defines a second flat surface 24. The second flat surface 24 is aligned with and opposite the first flat section 22 within the building block 10. In the assembled form, the first cap 16, the filler material, and the second cap 20 will have a thickness of between one-quarter inch and one inch.

The filler material 18 is a styrofoam material. It may have a plastic laminate on each side. This filler material has a configuration that matches the interior configuration of the first cap 16 and the second cap 20. The filler material 26 serves to properly position caps 16 and 20 relative to each other within the magnetic strip 14. Although the filler material 18 is specified within the preferred embodiment of the present invention, it may be possible to assemble and configure the present invention without the inclusion of filler material 18. Alternatively, filler material 18 may utilize material other than styrofoam.

It can be seen that the body 12 will have corners 28 of curved radius. The use of curved corners is a significant inventive aspect of the present invention. First, the curved corners 28 present a less dangerous surface to those children using the magnetic building block of the present invention. This is important since the caps 16 and 20 will be made of metal. The inclusion of the curved corners minimizes the danger presented by sharp edges. Also, the material used for the magnetic strip 14 cannot be easily shaped around and attached to sharp edges. As a result, the manufacture and assembly of the present invention becomes much easier when used in conjunction with the curved corners of the body 12.

Magnetic strip 14 has a generally rectangular configuration with curved corners 30. Importantly, magnetic strip 14 is made of a flexible magnetic strip. This flexible magnetic strip is of a type manufactured and sold by Magnet Sales and Manufacturing Co., Inc. These flexible magnets are made by a special process that orients the barium ferrite during manufacture and prior to magnetizing for a stronger magnetic field. The barium ferrite in this material gives high resistance to demagnetization. The material used for the magnetic strip 14 can be bent, twisted, coiled, punched, and otherwise machined into almost any shape without loss of magnetic energy. These materials conform to irregular shapes without cracking or springing back. In assembly, the interior surface 32 of magnetic strip 14 is adhesively affixed to the periphery of the body 12. The exterior surface 34 of magnetic strip 14 has a multiple magnetic pole surface. A special technique allows the exterior surface 34 of magnetic strip 14 to have magnetized multiple poles on one surface for greater magnetic strength. These are designed to reach through normal thicknesses of paint and still work effectively. As such, the exterior surface 34 of magnetic strip 14 may be properly painted as desired.

The use of the multiple pole exterior surface 34 achieves advantages not found in prior art magnetized building blocks. Most importantly, the magnetized multiple poles allow each side of magnetic strip 14 to be magnetically fastened to any side of another building block. In the prior art, it was necessary to align the poles of the magnetized surfaces so as to allow one building block to magnetically attach to another building block. By the use of the multiple pole surface 34, such considerations are unnecessary. The multiple pole surface will allow the building blocks 10 to be stacked upon one another or arranged in any desired order.

Figure 2:
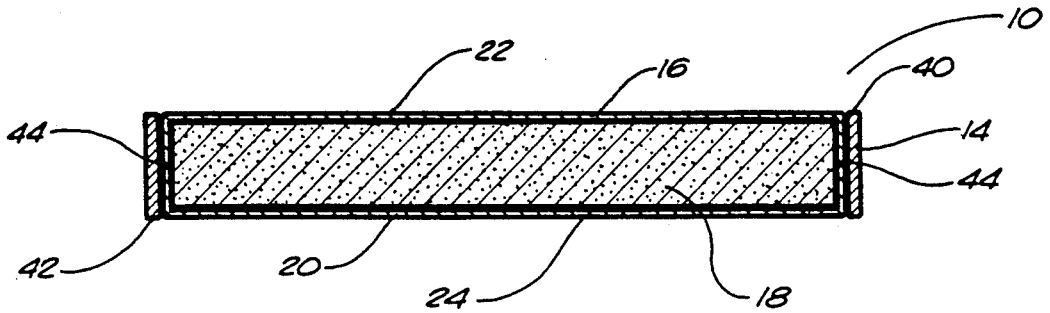
FIG. 2 is a cross-sectional view of the assembled magnetic building block of the present invention.

FIG. 2 is a cross-sectional view of the building block 10 in accordance with the preferred embodiment of the present invention. It initially can be seen that the first cap 16 has the flat surface 22 flush with the edge 40 of the magnetic strip 14. The second cap 20 is inverted relative to the first cap 16 and presents the second flat surface 24 flush with the edge 42 of magnetic strip 14. The filler material 18 is contained within the caps 16 and 20. It can be seen that the magnetic strip 14 is adhesively fastened to the side portions of the first cap 16 and the second cap 20. The ends 44 of each of the caps abut in the central area of the building block 10.

Figure 3:
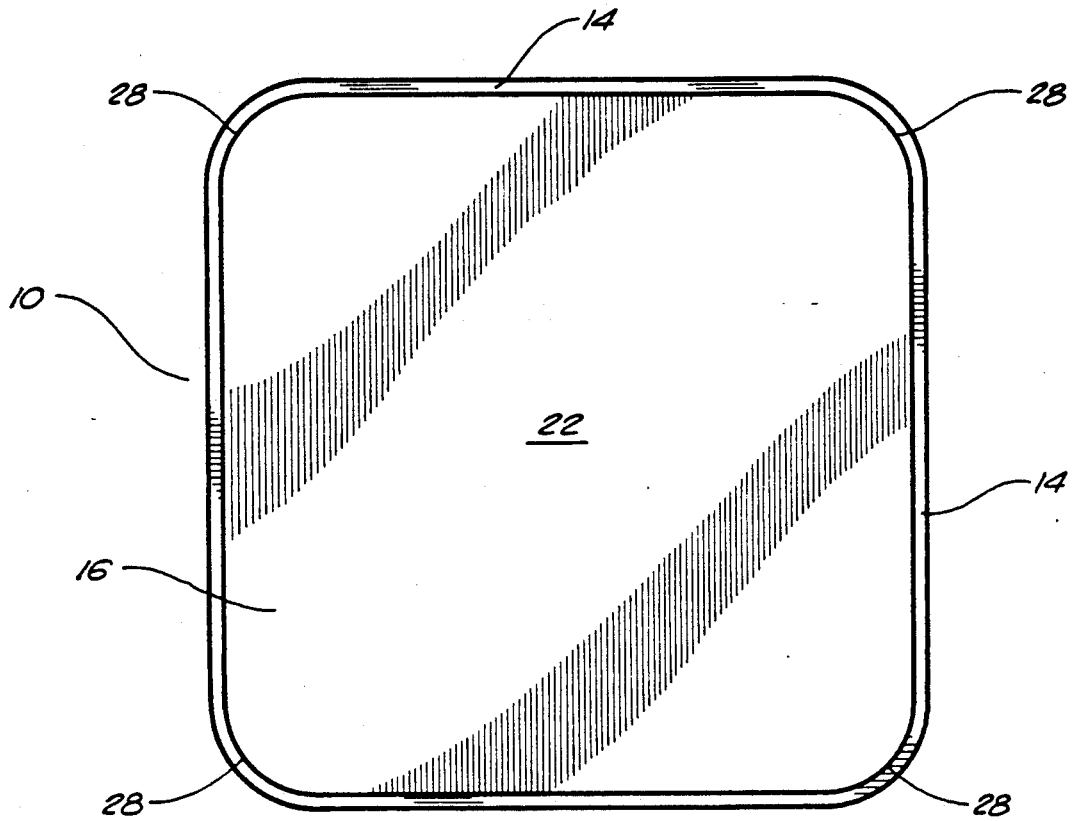
FIG. 3 is a top view of the magnetic building block of the present invention.

FIG. 3 is a top view of the building block 10. Specifically, in FIG. 3, it can be seen that the flat surface 22 of first cap 16 forms the central area of the building block. The magnetic strip 14 wraps around the periphery of the first cap 16 in the manner illustrated in FIG. 3. The corners 28 have a suitable radius so as to accommodate the attachment of the magnetic strip 14. The flat surface 22 has a relatively large area upon which written information can be received. For example, the building block may be used so as to increase its educational value. On the surface 22 may be placed various types of indicia such as letters, pictures, or the like. Theoretically, a child can learn by placing these blocks together in a given order, as in forming words, a complete picture comprised of a plurality of smaller pictures, or the like. The magnetic strip 14, extending around the periphery of surface 22, would allow the child to suitably attach each of the blocks together.

Figure 4:
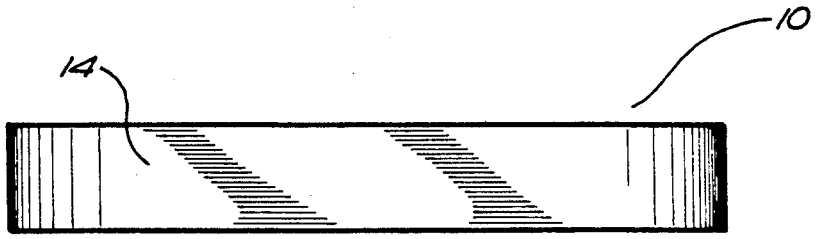
FIG. 4 is a view in side elevation of the magnetic building block of the present invention.

FIG. 4 is a side view of the building block 10 in accordance with the present invention. In the side view, it can be seen that the magnetic strip 14 is the only portion of the building block that is seen from this view. The first cap 16, the filler material 18, and the second cap 20 are hidden from view in this arrangement.

An important consideration of the present invention is that the width of the magnetic strip 14 should be between one-quarter inch and one inch. After experimentation, it was found that magnetic strips 14 having a width of less than one-quarter of an inch presented insufficient magnetic holding power to be useful for the purposes of the present invention. It is possible that, as stronger magnets are developed, that thinner strips of magnetic material could be utilized. Also, after experimentation, it was found that when the width of the magnetic strip 14 exceeded one inch, it became difficult to form the strip around the periphery of the building block. In addition, the costs of such wide magnetic strips exceeded their practical value. The optimal size of the magnetic strip 14 will be between one-quarter inch and one inch.

The building block 10 of the present invention offers a great improvement over prior magnetic building blocks. Specifically, each of the building blocks is suitable for attachment to any location on another building block. For example, the edge of the building block (represented by the magnetic strip 14) will attach to any part of the top surface 22 or the bottom surface 24. Since the top surface 22 and the bottom surface 24 are made of a magnetically attractive material, proper magnetic bonding will occur. Additionally, the building blocks may be placed edge to edge (magnetic strip 14 against another magnetic strip 14) by virtue of the multiple magnetic poles found in the strip itself. As a result, the child can construct various structures without regard to the polarity of the magnets within the building block.

An additional advantage is that the present invention is relatively easy to construct and safe to use. The curved corners of the building block will prevent accidental injury to the child. In addition, the rounded edges allow the magnetic strip to be more easily formed and attached about the periphery of the building block.

The foregoing disclosure and description of the invention is illustrative and explanatory thereof, and various changes in the size, shape, and materials, as well as in the details of the illustrated construction, may be made within the scope of the appended claims without departing from the spirit of the invention. This invention should only be limited by the appended claims and their legal equivalents.

I claim:

1. An apparatus comprising:

a metallic body;

a magnetic strip extending around the periphery of said metallic body, said magnetic strip permanently affixed to said metallic body, said magnetic strip having multiple alternating magnetic poles on an exterior surface of said magnetic strip opposite said metallic body.

2. The apparatus of claim 1, said metallic body comprising:

a first metallic cap; and a second metallic cap aligned with said first metallic cap, said magnetic strip extending around a plurality of sides of said first and second metallic caps.

3. The apparatus of claim 2, said first metallic cap defining a first flat surface, said second metallic cap defining a second flat surface opposite and aligned with said first flat surface.

4. The apparatus of claim 1, said magnetic strip being laminated continuously around said metallic body.

5. The apparatus of claim 1, said metallic body having a surface aligned with a edge of said magnetic strip.

6. The apparatus of claim 1, said metallic body having a plurality of corners of curved radius.

7. The apparatus of claim 2, further comprising:

a filler material contained between said first metallic cap and said metallic cap.

8. The apparatus of claim 7, said filler material comprising:

a styrofoam material having a plastic laminate on each side, said filler material having a configuration matching the interior configuration of said first and second metallic caps.

9. The apparatus of claim 1, said magnetic strip having a width of between one-quarter inch and one inch.

10. The apparatus of claim 1, said magnetic strip being of a flexible material, said magnetic strip having an interior surface in surface-to-surface contact with the periphery of said metallic body.

11. A children's toy comprising:

a body of a magnetically attractive material, said body comprising:

a first cap defining a first flat surface on an exterior of said body;

a second cap defining a second flat surface opposite and aligned with said first flat surface; and a filler material contained between said first and second caps; and a magnetic strip having an interior surface fastened around the periphery of said body, an exterior surface of said magnetic strip being of a multiple magnetic pole configuration.

12. The toy of claim 11, said first flat surface flush with one edge of said magnetic strip, said second flat surface flush with another edge of said magnetic strip.

13. The toy of claim 11, said body having corners of curved radius, said magnetic strip having a contour matching the curved radius of said corners.

14. The toy of claim 11, said magnetic strip being laminated to said body.

15. A building block comprising:

a first cap defining a first flat surface;

a second defining second flat surface aligned with and opposite said first flat surface; and a magnetic strip having an inner surface fastened to the periphery of said first and second caps, the edges of said magnetic strip being flush with said first flat surface and said second flat surface.

16. The block of claim 15, further comprising:

a filler material contained between said first cap and said second cap, said magnetic strip having an exterior surface of a multiple magnetic pole configuration.

* * * * *